US008491155B1

(12) United States Patent
Cherry, II et al.

(10) Patent No.: US 8,491,155 B1
(45) Date of Patent: Jul. 23, 2013

(54) SOLID STATE LIGHTING SYSTEM

(75) Inventors: James W. Cherry, II, Louisville, KY (US); Todd P. Fricke, New Albany, IN (US); John T. Quesenberry, Crestwood, KY (US); Nathan A. Thomas, Louisville, KY (US); John C. Vellinger, Floyds Knobs, IN (US)

(73) Assignee: Techshot, Inc., Greenville, IN (US)

( * ) Notice: Subject to any disclaimer, the term of this patent is extended or adjusted under 35 U.S.C. 154(b) by 959 days.

(21) Appl. No.: 12/574,771

(22) Filed: Oct. 7, 2009

Related U.S. Application Data

(60) Provisional application No. 61/103,388, filed on Oct. 7, 2008.

(51) Int. Cl.

| | |
|---|---|
| ***F21S 4/00*** | (2006.01) |
| ***F21V 21/00*** | (2006.01) |
| ***H05B 37/00*** | (2006.01) |
| ***H05B 39/00*** | (2006.01) |
| ***H05B 41/00*** | (2006.01) |
| *H05B 41/14* | (2006.01) |
| *H05B 41/16* | (2006.01) |
| *H05B 41/24* | (2006.01) |

(52) U.S. Cl.
USPC ..... 362/249.02; 315/185 R; 315/200 R; 315/246; 362/404

(58) Field of Classification Search
USPC ..... 362/407
See application file for complete search history.

(56) References Cited

U.S. PATENT DOCUMENTS

| | | | | |
|---|---|---|---|---|
| 7,081,645 | B2 | 7/2006 | Chen et al. | |
| 7,344,275 | B2 * | 3/2008 | Allen et al. | 362/249.01 |
| 7,352,138 | B2 | 4/2008 | Lys et al. | |
| 7,682,049 | B2 * | 3/2010 | Zheng et al. | 362/294 |
| 2006/0262545 | A1 | 11/2006 | Piepgras et al. | |
| 2007/0242455 | A1 * | 10/2007 | Fair et al. | 362/249 |

* cited by examiner

*Primary Examiner* — Douglas W Owens
*Assistant Examiner* — Dedei K Hammond
(74) *Attorney, Agent, or Firm* — Wood Herron & Evans LLP

(57) ABSTRACT

A solid state lighting system and components therefor are provided that are modular, rugged, reliable and energy efficient. Heat dissipation with respect to solid state light fixtures may be addressed by inverting the solid state lights on a circuit board to project light through apertures in the circuit board, so that heat need not be dissipated through the circuit board itself. In addition, solid state light fixtures may be coupled to one another along with a power supply in modular strands that incorporate AC/DC multi-wire cords that carry both AC and DC signals. Additional functionality, such as support for multiple lighting modes, may also be included, e.g., to support blackout lighting in addition to standard lighting. The multiple lighting modes may be selected, for example, by adjusting an electrical parameter of the AC power signal supplied to the lighting system, e.g., by rectifying the AC power signal.

26 Claims, 10 Drawing Sheets

SOLID STATE LIGHTING SYSTEM

CROSS-REFERENCE TO RELATED APPLICATIONS

This application claims priority on U.S. Provisional Patent Application Ser. No. 61/103,388 filed on Oct. 7, 2008 by James W. Cherry II et al. and entitled "SOLID STATE LIGHTING SYSTEM," the entire disclosure of which is incorporated by reference herein.

FIELD OF THE INVENTION

The invention relates to lighting systems, and in particular to solid state lighting systems such as Light Emitting Diode (LED)-based lighting systems.

BACKGROUND OF THE INVENTION

Some applications and environments can present tremendous challenges for lighting systems. For example, the lighting systems used in tents and portable shelters, e.g., as may be used in military applications, disaster relief applications, and emergency applications, as well as used in fixed structures such as refineries, mines and other industrial, residential and commercial applications, are often exposed to extreme conditions. Conventionally, such lighting systems have relied upon incandescent or fluorescent bulbs, both of which are relatively fragile, and which as a result often require bulky housings to protect the bulbs from breakage. Also, due to the temporary nature of such shelters, the lighting systems are often left exposed and subject to being inadvertently bumped by personnel or equipment, increasing the risk of breakage. Lighting systems may also be exposed to harsh operating conditions, which for fluorescent-based approaches can lead to poor light output, e.g., in cases of extreme cold.

In addition, due to the bulkiness and fragility of conventional lighting systems, the systems are often installed in a facility only after the facility has been constructed, and must be removed before the facility can be broken down for stowage or transport. Particularly in large facility or shelter complexes, where tens or hundreds of rapidly deployable shelters need to be constructed in a short period of time, the additional labor required to install and tear down the lighting systems can be excessively burdensome.

Energy consumption is also a significant concern for many lighting systems. Incandescent bulbs are extremely inefficient, leading to excessive energy costs, power consumption, and heat generation, the latter of which may require special accommodations to reduce the risk of fire.

In addition, in some military applications, it may be desirable to provide "blackout" capability in a lighting system for the protection of military personnel in battlefield environments. Conventionally, when blackout conditions are required, military personnel are typically required to place a color filter over each light fixture to filter out infrared radiation. In some fluorescent fixtures, for example, retractable filter screens are built into the housings, so that military personnel can manually slide the filter screens over the fluorescent bulbs when blackout conditions are required. In an installation of hundreds or thousands of individual fixtures in a facility or complex, however, the time and effort required to convert all fixtures to a blackout condition can be excessively long, potentially increasing the danger to military personnel health and well being.

One technology that is increasingly being used in lighting systems is solid state Light Emitting Diode (LED)-based lighting. LED lights tend to be more durable and longer lasting than incandescent and fluorescent lights, and the efficiency continues to increase to the point that current LED lights are comparable to fluorescent lights, and are continuing to improve.

Solid state lighting systems, however, are also subject to numerous drawbacks and challenges. For example, heat dissipation is currently a significant problem for LED light fixtures. The LED's used in lighting fixtures are often packaged with integrated heat sinks, and the packages are typically mounted on a circuit board. A larger, more efficient cooling system, e.g., using a larger heat sink and/or other cooling components, is then mounted to the opposite side of the circuit board, so that the generated heat is dissipated through the circuit board. While metallic through holes may be used to improve the dissipation of heat through the circuit board, however, the conduction of heat through the circuit board remains a problem with respect to fixture reliability. Another drawback of LED lights is the directed nature of the light generated by the LED's. It is desirable in many lighting environments for the light to be evenly dispersed and consistent throughout a lit area. Conventional LED light fixtures, however, often generate (hot) bright spots and subsequently dark spots within illuminated areas.

Therefore, a significant need continues to exist in the art for a solid state lighting system that overcomes the aforementioned drawbacks of conventional lighting systems.

SUMMARY OF THE INVENTION

The invention addresses these and other problems associated with the prior art by providing a solid state lighting system and components therefor that is modular, reconfigurable, rugged, reliable and energy efficient. In addition, in some embodiments, additional functionality, such as support for multiple lighting modes, may be included, e.g., to support blackout lighting in addition to standard lighting.

In one aspect, for example, solid state lights, e.g., LED lights, may be mounted in an inverted non-standard orientation on a circuit board to permit heat to be dissipated from the lights without being conducted through the circuit board. Consistent with this aspect of the invention, for example, a lighting apparatus may include a circuit board including first and second opposing surfaces and an aperture extending between the first and second surfaces. The lighting apparatus may also include a solid state light mounted to the first surface of the circuit board and oriented in an inverted orientation to project light through the aperture in the circuit board.

In another aspect, solid state lights may be provided in a modular system that relies on multi-fixture strands having in-line power supplies and opposing male and female connectors that enable strands to be easily daisy-chained together, and if desired, controlled by a common controller. Consistent with this aspect of the invention, a lighting apparatus may include an AC/DC multi-wire cord including cooperative male and female connectors disposed at opposing ends thereof and coupled to one another by first and second AC wires extending through the AC/DC multi-wire cord; a power supply coupled to the multi-wire cord and electrically coupled to the AC wires, the power supply configured to generate a DC voltage from an AC voltage received over the AC wires; a plurality of solid state light fixtures coupled to the multi-wire cord; and a plurality of DC wires disposed within the multi-wire cord and electrically coupling the power supply to each of the solid state light fixtures to power each light fixture with the DC voltage generated by the power supply.

In another aspect, a lighting system may be configured to support multiple lighting modes that are controlled by a characteristic of the AC power signal that is supplied thereto. For example, in one embodiment, a blackout mode may be supported, e.g. for military applications, where a lighting apparatus may be switched from a normal mode to a blackout mode merely through adjusting the AC power signal supplied to the lighting apparatus.

In one embodiment of the invention, for example, a lighting system may include a controller configured to receive an AC power signal, the controller further configured to selectively rectify the AC power signal to select a blackout lighting mode; and a plurality of solid state lighting strands coupled to the controller in a daisy-chained arrangement and configured to be mounted in a shelter. Each solid state lighting strand may include an AC/DC multi-wire cord including cooperative male and female connectors disposed at opposing ends thereof and coupled to one another by first and second AC wires and an AC ground wire extending through the AC/DC multi-wire cord; a power supply coupled in-line with the multi-wire cord between the male and female connectors and electrically coupled to the AC wires, the power supply configured to generate a DC voltage from an AC voltage received over the AC wires, and the power supply further configured to detect rectification of the AC power signal by the controller to select the blackout lighting mode; a plurality of solid state light fixtures coupled to the multi-wire cord and configured to hang from the multi-wire cord and project light in a downward direction when the AC/DC multi-wire cord is suspended in a generally horizontal orientation in the shelter, each solid state light fixture including a set of white Light Emitting Diodes (LED's) and a set of blue LED's; and a plurality of DC wires disposed within the multi-wire cord and electrically coupling the power supply to each of the solid state light fixtures to power each light fixture with the DC voltage generated by the power supply, where the power supply is configured to energize the set of white LED's in each solid state light fixture when the AC power signal is not rectified by the controller, and to energize the set of blue LED's in each solid state light fixture when the AC power signal is rectified by the controller.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

DETAILED DESCRIPTION

Embodiments consistent with the invention employ solid state lights such as LED's in a modular lighting system to provide rugged, reliable and energy efficient lighting in shelters such as tents, rapidly deployable shelters and other temporary structures, e.g. as may be used in military, disaster relief, and similar applications. It will be appreciated, however, that aspects of the invention may have uses in other applications beyond shelter lighting, and therefore, the invention is not limited to shelter lighting applications. In addition, it will be appreciated that certain aspects of the solid state shelter lighting system described herein may have separate utility, and thus, embodiments consistent with the invention may utilize only a subset of the features described herein.

Figure 1:
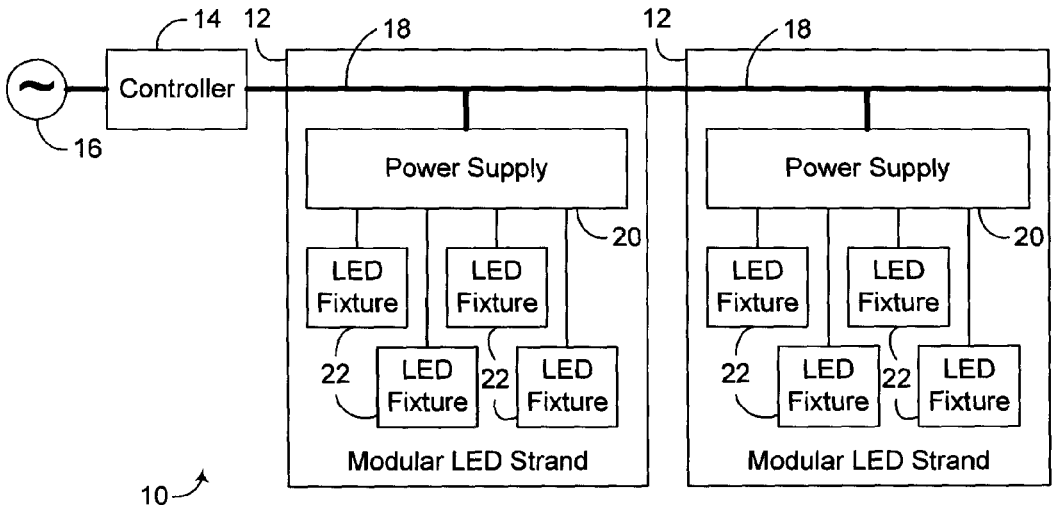
FIG. 1 is a block diagram of one implementation of a solid state shelter lighting system consistent with the invention.

Turning now to drawings, wherein like numbers denote like parts throughout the several views, FIG. 1 illustrates a solid state shelter lighting system 10 consistent with the invention. System 10 includes a plurality of daisy-chained modular LED strands 12 coupled to a controller 14 and powered by an AC power source 16. AC power from source 16 is provided by controller 14 over power lines 18 to a power supply 20 disposed in each strand 12. Power supply 20 provides a source of DC power to a plurality of LED fixtures 22 disposed in each strand 12. In the illustrated embodiment, each strand includes four fixtures 22, although any number of fixtures may be used in other embodiments.

Figure 2:
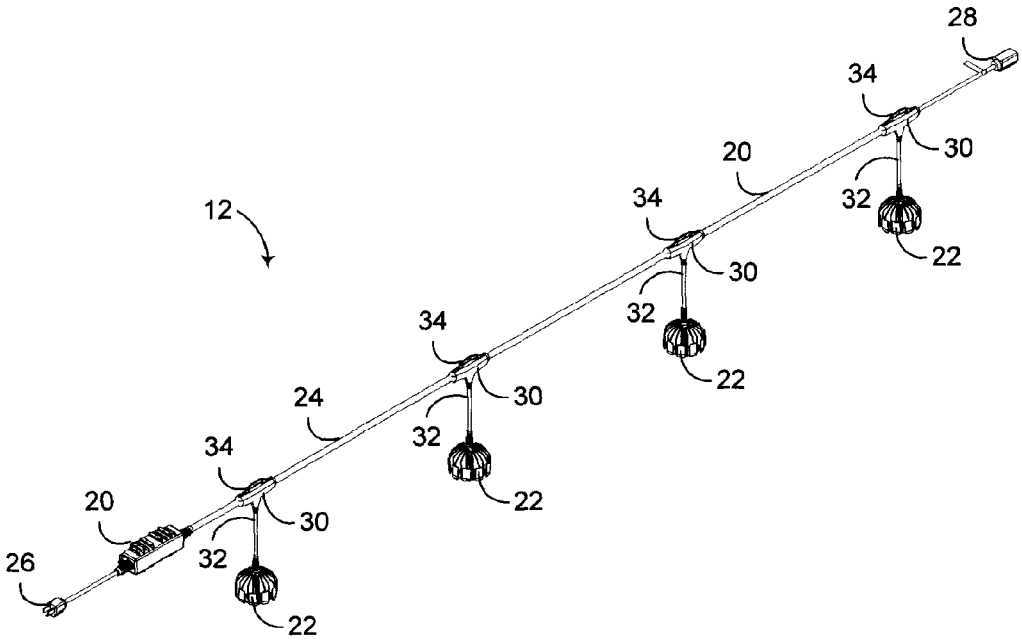
FIG. 2 is a perspective view of one of the modular LED strands of FIG. 1.

As shown in FIG. 2, each strand 12 may include an AC/DC multi-wire cord 24 having a male-type plug 26 at one end and a female-type plug 28 at the opposite end, with the power supply 20 disposed in-line along AC/DC multi-wire cord 24. Each connector 26, 28 may be a NEMA connector for USbased installations, or may include other suitable AC power cord connectors compatible with other countries' standards. In some embodiments, one of connectors 26, 28 may be omitted.

As will be discussed in greater detail below, AC/DC multi-wire cord includes wires that carry AC signals as well as wires that carry DC signals. The wires may be formed as part of a multi-conductor cable, or may be formed from separate cables that are joined together in a sleeve.

Each LED fixture 22 is coupled to AC/DC multi-wire cord 24 via a junction or connector 30, and hangs from a DC multi-wire cord 30 over which DC signals from power supply 20 are provided (discussed below). In addition, each junction/connector 30 may include a hook 34 or other suitable structure for hanging or mounting strand 12 to a structure, e.g., via hook and loop fastener or other suitable attachment devices. In other embodiments, hooks may be omitted, or other attachment devices (e.g., disposed on cord 34) may be used in the alternative.

Multiple LED strands 12 are therefore be connected to one another in a daisy-chained relationship, with the male plug 26 of one strand 12 coupled to the female plug of the other strand 12, and with the strand 12 having a free male plug 26 coupled to a source of AC power.

Figure 3:
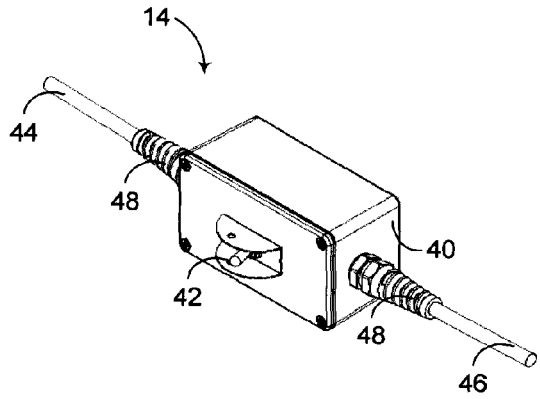
FIG. 3 is a perspective view of the controller of FIG. 1.

While LED strands 12 may be coupled to a source of AC power without the use of a controller, in the illustrated embodiment, an additional controller 14 (FIG. 1) is coupled in line with strands 12 between strands 12 and AC power source 16. FIG. 3 illustrates one implementation of a controller 12, including a housing 40, switch 42, AC power cords 44, 46 and fittings 48. Cooperating male and female NEMA plugs (not shown) may be included at the ends of power cords 44, 46 such that the controller may be coupled in-line with strands 12.

Figure 4:
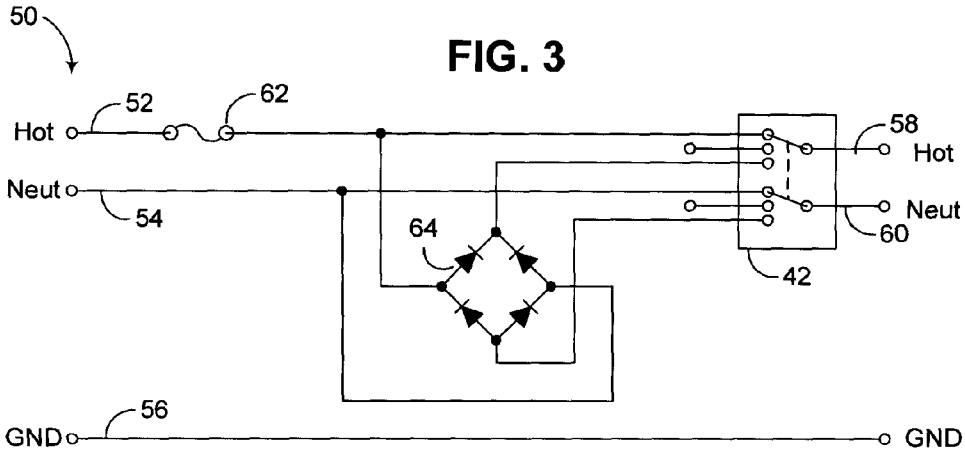
FIG. 4 is a circuit diagram of one exemplary implementation of a controller circuit for the controller of FIG. 3.

FIG. 4 illustrates one implementation of a controller circuit 50 implemented within controller 14. While in some embodiments it may be desirable to support only a signal lighting mode for system 10, in the illustrated embodiment, multiple lighting modes are supported in controller 14 by altering the AC power signal supplied to each LED strand 12 to cause each strand to operate according to the desired mode. In the illustrated embodiment, controller circuit 50 selectively rectifies the incoming AC power signal in order to select a secondary lighting mode.

Specifically, controller circuit 50 includes hot and neutral input leads 52, 54 and a chassis ground lead 56 that are coupled to power cord 44. Chassis ground lead 56 couples directly to power cord 46, while hot and neutral leads 52, 54 are coupled to hot and neutral output leads 58, 60 via switch 42. A fuse 62 may also be disposed in the hot signal path. In some embodiments, it may be desirable to utilize a resettable circuit breaker or an easily accessible and replaceable fuse to simplify servicing in the field after a fault.

Figure 5:
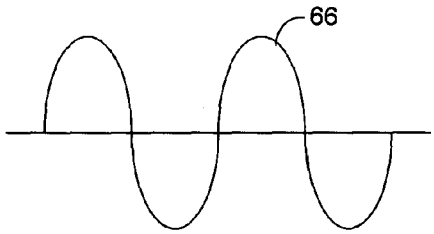
FIG. 5 is a waveform diagram illustrating an AC power signal output by the controller circuit of FIG. 4 when operating in a normal mode.
Figure 6:
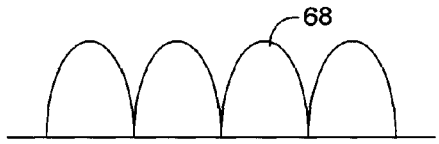
FIG. 6 is a waveform diagram illustrating an AC power signal output by the controller circuit of FIG. 4 when operating in a blackout mode.

Switch 42 is a two pole, three position switch, with the center position left unconnected for an "off" position. Another position of switch 42, which is used for the primary lighting mode, is coupled directly to hot and neutral input leads 52, 54 to pass the AC power signal unchanged to the output leads 58, 60. The third position of switch 42 is coupled to a bridge rectifier 64 that is powered by the AC power signal via input leads 52, 54. FIG. 5, for example, illustrates the waveform 66 of the AC power signal output at output leads 58, 60 when operating in the primary lighting mode, while FIG. 6 illustrates the waveform 68 of the AC power signal output at output leads 58, 60 when operating in the secondary lighting mode.

It will be appreciated that other manners of modifying the AC power signal supplied to LED strands 12 may be used to select different lighting modes, e.g., by varying the frequency, amplitude, and/or other waveform characteristic of the AC power signal in such a manner that mode selection information is conveyed to each strand. In addition, mode selection information may be modulated on the AC power signal in some embodiments, and separate dedicated control lines may be used in some embodiments. It will also be appreciated that more than two lighting modes may be supported. For example, a third mode could be supported in circuit 50 through the use of a second bridge rectifier that is configured to generate an inverted version of the waveform illustrated in FIG. 6.

In the illustrated embodiment, the secondary lighting mode may be a blackout, which causes each LED strand 12 to energize a set of blue LED's to minimize the infrared signature of the LED fixtures. However, it will be appreciated that the manner in which lighting modes may differ may vary in different embodiments. For example, lighting modes may be used to select different colors of LED's, to select different brightness, to select different illumination patterns (e.g., to switch between narrow and wide beams), to selectively energize only a subset of LED fixtures, etc. Other variations will be apparent to one of ordinary skill in the art having the benefit of the instant disclosure.

Figure 7:
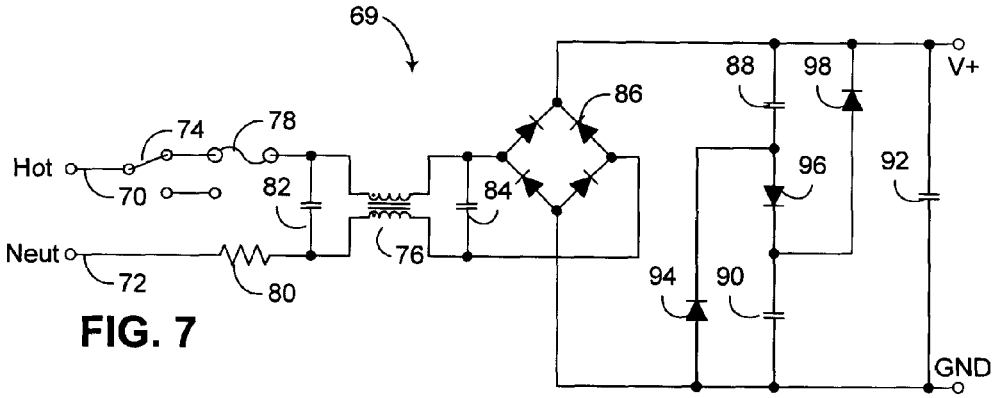
FIGS. 7-9 are circuit diagrams of one exemplary implementation of a power supply circuit for one of the power supplies of FIG. 1.
Figure 8:
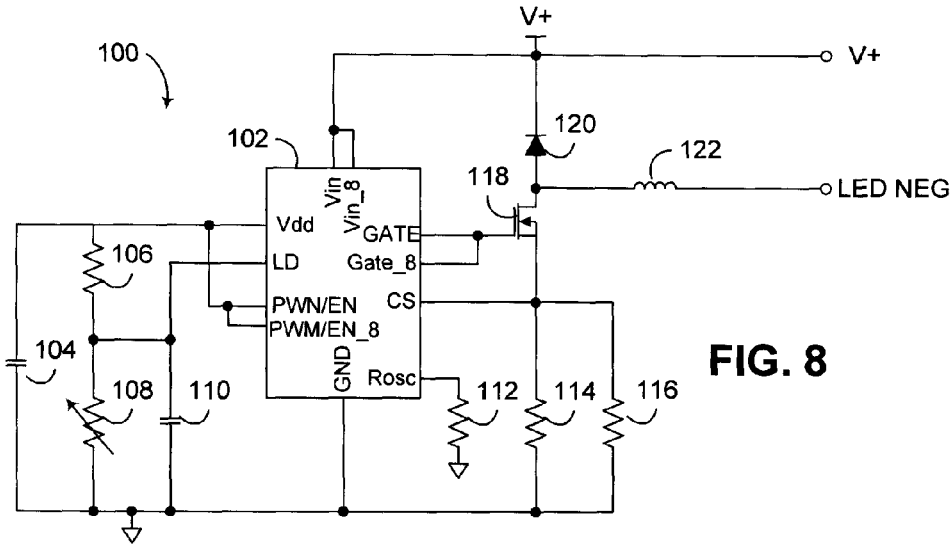
Figure 9:
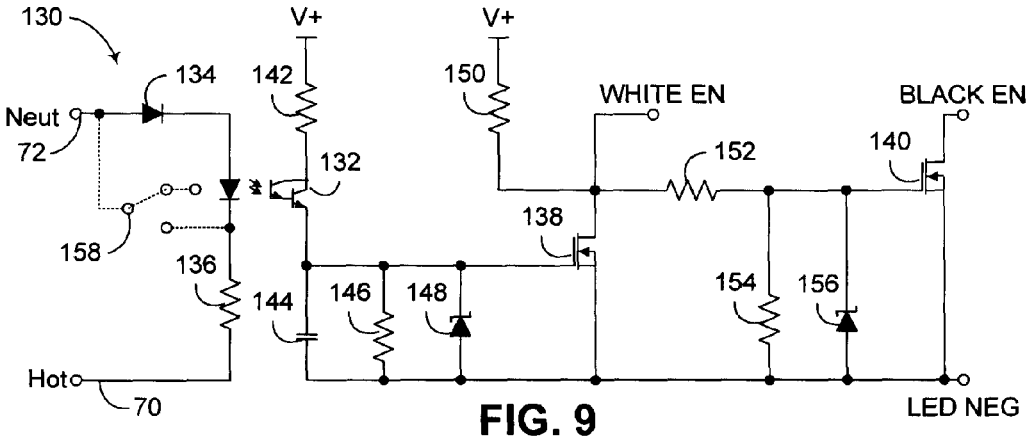

FIGS. 7-9 illustrate one exemplary power supply circuit suitable for use in the power supply 20 of each LED strand 12 (FIG. 1), and suitable for selecting from among multiple lighting modes in response to the selective rectification of the AC power signal supplied to each LED strand. In the illustrated embodiment, the power supply circuit is a constant current switching power supply, configured to supply a constant current to the LED's in each strand 12 and thereby provide a constant level of illumination.

FIG. 7, for example, illustrates an AC/DC converting portion 69 of the power supply circuit. Hot and neutral leads 70, 72 are provided as an input to the circuit, and an optional two position on/off switch 74 is used to turn the associated strand on or off. Leads 70, 72 are respectively coupled to a common mode EMI choke 76 via a slo blo fuse 78 and thermal resistor 80, and a pair of capacitors 82, 84 (e.g., 0.1 uF) are coupled in parallel on opposite sides of choke 76. AC to DC conversion is performed by a rectifier circuit including a bridge rectifier 86, capacitors 88, 90 (e.g., 100 uF), capacitor 92 (e.g., 1.0 uF) and diodes 94, 96, 98, which provides a balanced DC output between the V+ and GND leads of about 168 VDC.

FIG. 8 illustrates a switcher portion 100 of the power supply circuit. Vin and Vin_8 pins of a switching controller 102, e.g., an HV9910 LED driver are coupled to V+. A Vdd pin is coupled to ground through a capacitor 104 (e.g., 2.2 uF) and series connection of resistors 106 (e.g., 178 KΩ) and 108 (e.g., 6.04 KΩ). Of note, resistor 108 may be configured as a variable resistor as shown in FIG. 8 to provide dimming functionality in some embodiments of the invention. An LD pin is coupled to ground through capacitor 110 (e.g., 0.1 uF), as well as to the common junction between resistors 106, 108. PWN/EN and PWN/EN_8 pins are coupled to Vdd, and the GND pin of controller 102 is coupled directly to ground. The Rosc pin of controller 102 is coupled to ground via a resistor 112 (e.g., 464 KOhm), and a CS pin is coupled to ground via parallel resistors 114, 116 (each e.g., 0.27 Ohm). The CS pin is also coupled to the source of a MOSFET 118, the gate of which is coupled to GATE and Gate_8 pins of controller 102. The drain of MOSFET 118 is coupled to an LED NEG node, which is the return path for the driven LED's, and is additionally coupled to V+ through a diode 120.

FIG. 9 illustrates a mode selection portion 130 of the power supply circuit. An opto-isolator 132 is coupled intermediate hot and neutral leads 70, 72 in series with a diode 134 and resistor 136 (e.g., 169 KOhm). Opto-isolator 132 controls a pair of MOSFETs 138, 140 which respectively select between the primary and secondary modes by selectively coupling either a WHITE EN signal (in the primary mode) or a BLACK EN signal (in the secondary mode) to the LED NEG driver return path.

Opto-isolator 132 is coupled to V+ via a resistor 142 (e.g., 100 KOhm), and coupled to the gate of MOSFET 138. The gate of MOSFET 138 is also coupled to ground through parallel capacitor 144 (e.g., 0.1 uF), resistor 146 (e.g., 330 KOhm) and zener diode 148. The source of MOSFET 138 is coupled directly to ground.

The drain of MOSFET 138 is coupled to V+ through a resistor 150 (e.g., 100 KOhm), and is further coupled to the gate of MOSFET 140 via a resistor 152 (e.g., 100 KOhm). The gate of MOSFET 140 is coupled to ground through parallel resistor 154 (e.g., 1 MOhm) and zener diode 156, and the source of MOSFET 140 is coupled directly to ground. The WHITE EN and BLACK EN nodes are coupled directly to the drains of MOSFETs 138, 140, respectively.

Opto-isolator 132 is configured to be energized in response to a negative voltage. Thus, when an unaltered AC power signal is supplied to opto-isolator 132, as when the controller is operating in the primary mode, opto-isolator 132 is energized, with the RC net formed by resistors 142, 146 and capacitor 144 generating a steady DC voltage at the gate of MOSFET 138. A positive voltage at the gate of MOSFET 138 energizes the MOSFET, thus coupling the WHITE EN node to the LED driver return path and driving the LED's coupled thereto. In addition, energizing MOSFET 138 drops the gate voltage for MOSFET 140 to OVDC, shutting off the MOSFET and isolating the BLACK EN signal from the LED driver return path, such that any LED's coupled to the BLACK EN signal are shut off.

When a rectified AC power signal is supplied to opto-isolator 132, as when the controller is operating in the secondary mode, opto-isolator 132 is shut off, which drives the gate of MOSFET 138 to OVDC, shutting off the MOSFET, and thus isolating the WHITE EN node from the LED driver return path and shutting off the LED's coupled thereto. In addition, shutting off MOSFET 138 couples the of MOSFET 140 to V+, energizing the MOSFET and coupling the BLACK EN signal to the LED driver return path, such that any LED's coupled to the BLACK EN signal are turned on.

As is also shown in FIG. 9, in some embodiments it may be desirable to provide an individual blackout or secondary mode switch 158 coupled in parallel with opto-isolator 132 and diode 134 to selectively disable the opto-isolator and thereby maintain the power supply in the secondary mode regardless of whether the secondary mode has been selected with the controller.

Figure 10:
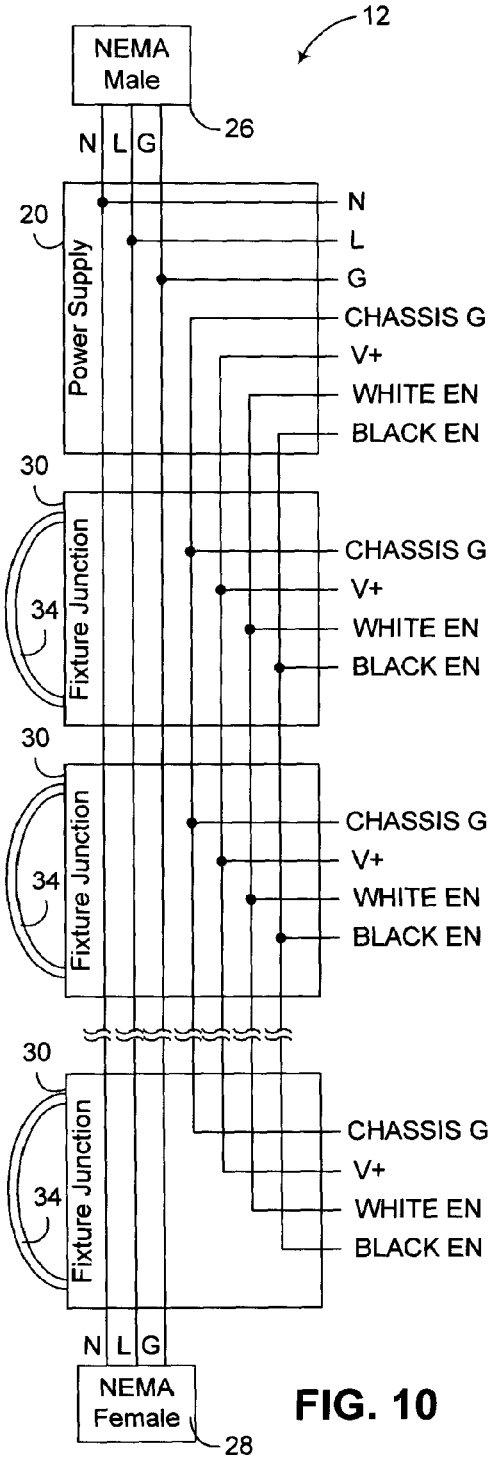
FIG. 10 is a block diagram illustrating an exemplary wiring implementation for one of the modular LED strands of FIG. 1.

FIG. 10 illustrates the wiring utilized in each LED strand 12, and disposed within AC/DC multi-wire cord 24. AC Hot (L), Neutral (N) and Ground (G) wires (e.g., 18 gauge) run between male and female plugs 26, 28, and are coupled to power supply 20. Power supply 20 in turn outputs a separate chassis ground (CHASSIS G), as well as the aforementioned V+, WHITE EN and BLACK EN signals to each fixture via junctions 30, e.g., using 22 gauge wires. Typically, all seven wires are routed within AC/DC multi-wire cord 24 (FIG. 1).

Figure 11:
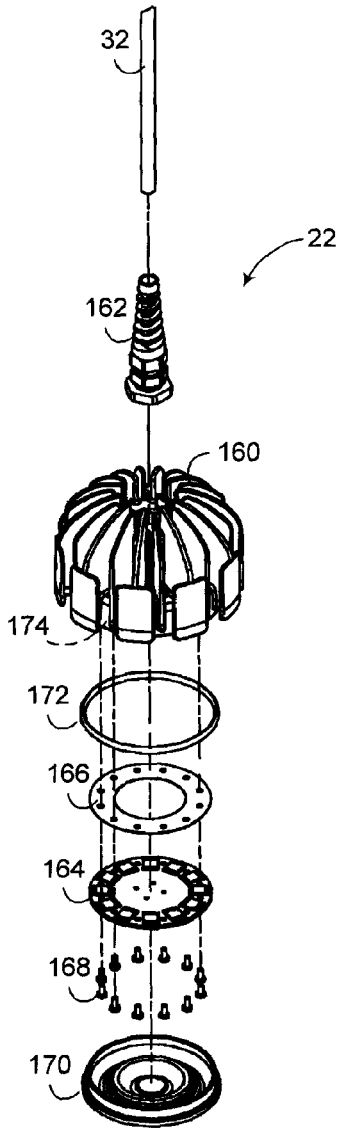
FIG. 11 is an exploded perspective view of one of the LED fixtures of FIG. 2.
Figure 12A:
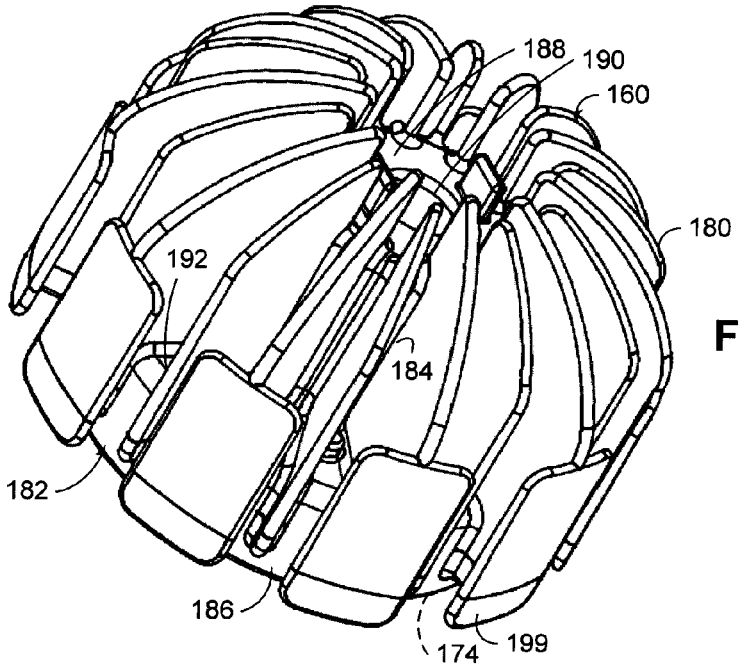
FIG. 12A is a top left perspective view of the housing of FIG. 11.
Figure 12B:
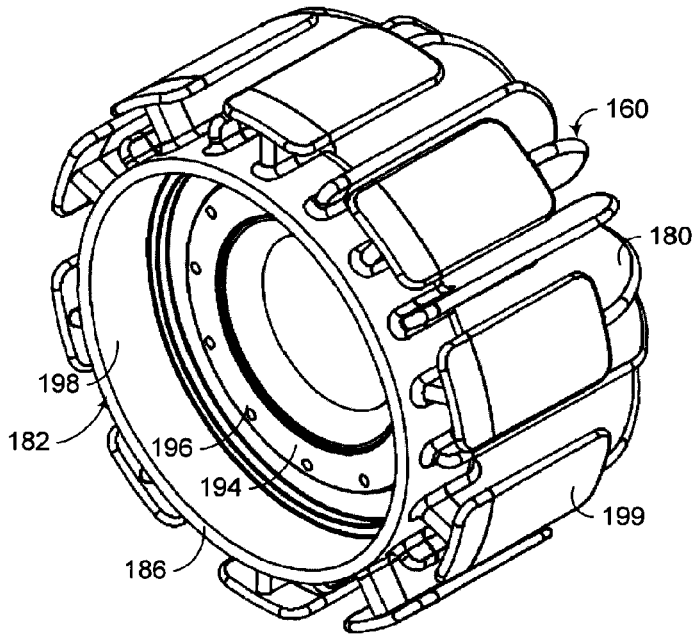
FIG. 12B is a bottom right perspective view of the housing of FIG. 11.
Figure 12C:
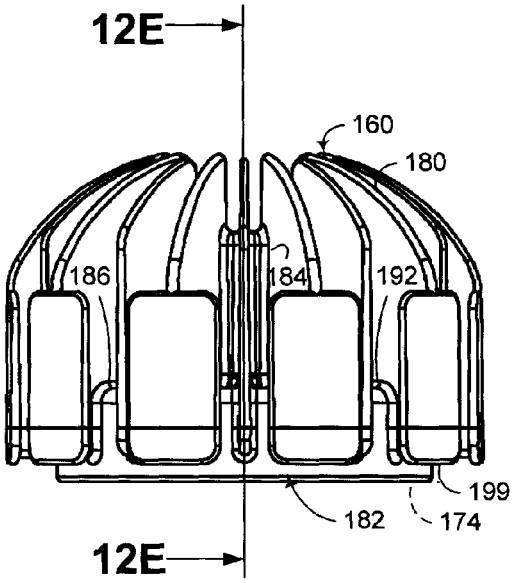
FIG. 12C is a side elevation view of the housing of FIG. 11.
Figure 12D:
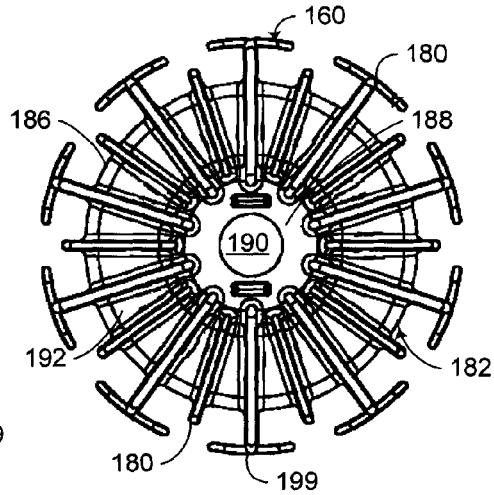
FIG. 12D is a top plan view of the housing of FIG. 11.
Figure 12E:
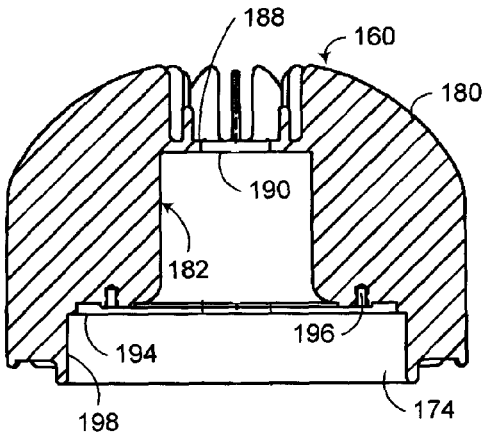
FIG. 12E is a cross-sectional view of the housing of FIG. 11, taken along lines 12E-12E of FIG. 12C.
Figure 12F:
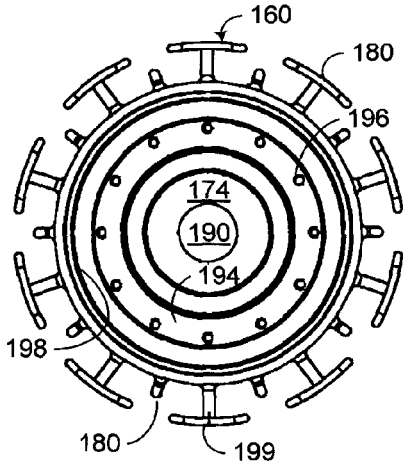
FIG. 12F is a bottom plan view of the housing of FIG. 11.

FIG. 11 next illustrates an LED fixture 22 consistent with the invention. Fixture 22 includes a housing 160 that also serves as a heat sink, with the multi-line cord 32 entering into the housing from the top, and secured via a weatherproof fitting or cord grip 162. A fixture circuit assembly 164, upon which the LED's for the fixture are mounted, is secured within a cavity 174 of housing 160 through a cooperating thermal pad 166 and fasteners 168. The fixture circuit assembly is then sealed within the cavity by a lens 170 that is friction mounted to the housing an EPDM O-ring 172, which also seals the cavity from the elements. Other mechanisms for securing fixture circuit assembly 164 (e.g., snap fit engagements) and lens 170 (e.g., fasteners) in cavity 174 may be used in other embodiments. For example, it may be desirable to utilize a modular and easily removable design whereby different fixture circuit assemblies may be usable within a given fixture, e.g., to enable easy replacement in the case of a circuit assembly failure, to enable newer fixture circuit assemblies (e.g., incorporating newer, less expensive, and more efficient LED's that may be developed in the future) to replace older fixture circuit assemblies, or to enable different lighting profiles to be supported by the same fixture design (e.g., by providing circuit assemblies with different numbers of LED's, different colors of LED's, different light outputs, etc.). It should be noted that it is typically desirable to recess fixture circuit assembly 164 within cavity 174 to protect the LED's disposed thereon from breakage resulting from shocks to the housing.

One suitable design for housing 160 is illustrated in greater detail in FIGS. 12A-12F. Housing 160 may be formed of a cast thermally conductive material, e.g., cast aluminum, to dissipate heat generated by the LED's in LED fixture 22. In the illustrated embodiment, housing 160 includes a plurality of vertically-oriented fins 180 extending from a central core 182. Core 182 includes an upper columnar portion 184 and a lower bell-shaped portion 186, within which cavity 174 for the housing is defined. A top surface 188 of core 182 includes an aperture 190 to which fitting 162 is secured and through which cord 32 enters cavity 174. A generally horizontal shoulder portion 192 of core 182 defines a ring-shaped mounting surface 194 in cavity 174 for mounting fixture circuit assembly 164 within the cavity, e.g., through the use of fasteners 168 (FIG. 11) engaging with a plurality of threaded apertures 196. Cavity 174 also includes a vertically-extending inner wall 198 against which O-ring 172 is compressed when lens 170 (FIG. 11) is friction fitted within cavity 174, thereby sealing the cavity.

Housing 160 forms a heat sink for LED fixture 22, and fins 180, through which much of the heat generated by the LED's (which is conducted to fins 180 through mounting surface 194 and core 182) is dissipated, are vertically-oriented to provide a chimney effect and thereby improve heat dissipation. The vertical orientation of the fins also minimizes the collection of dust or other contaminants on the surfaces of the fins, which might otherwise inhibit heat dissipation. In some designs, it may also be desirable in some embodiments to slope shoulder portion 192 of core 182 to further reduce dust collection on the surfaces of core 182.

Alternate fins 180 of housing 160 also include transverse tabs 199, which, in addition to providing some shock absorption to protect fins 180 from bending or breaking when the fixture is dropped, and facilitating handling of the fixture, are also size, shaped and numbered so as to provide a pleasing and attractive aesthetic appearance for the fixture.

Figure 13:
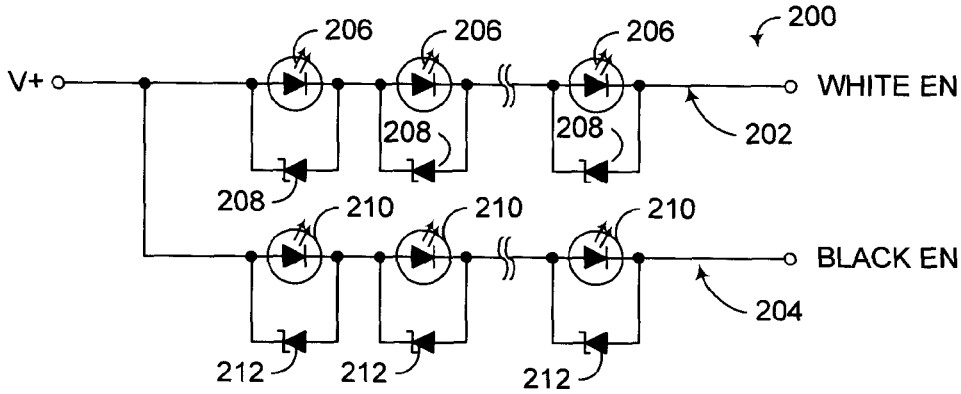
FIG. 13 is a circuit diagram of one exemplary implementation of a circuit for the fixture circuit assembly of FIG. 11.

FIG. 13 next illustrates a circuit diagram of a circuit 200 that may be utilized in fixture circuit assembly 164. Circuit 200 includes two branches 202, 204 coupled to a common node that receives the V+ wire from power supply 20. Branch 202 includes a series connection of LED's 206, with each LED 206 coupled in parallel with a zener diode 208, and is coupled to the WHITE EN wire from power supply 20, such that current flows through LED's 206 whenever the WHITE EN wire is coupled to the LED NEG return path in power supply 20 (FIG. 9). Similarly, branch 204 includes a series connection of LED's 210, with each LED 210 coupled in parallel with a zener diode 212, and is coupled to the BLACK EN wire from power supply 20, such that current flows through LED's 210 whenever the BLACK EN wire is coupled to the LED NEG return path in power supply 20 (FIG. 9). Consequently, when power supply 20 selects between the primary and secondary lighting modes, LED's 206 are energized when in the primary lighting mode, while LED's 210 are energized when in the secondary lighting mode.

In the illustrated embodiment, with the secondary lighting mode being a blackout mode, LED's 210 are blue LED's, generating light with little or no infrared output, e.g., about 450 nm wavelengths. In addition, in the illustrated embodiment, LED's 206 are white LED's that generate light suitable for ordinary illumination. In addition, the number of LED's disposed in each branch 202, 204 of circuit 200 may vary in different embodiments. In the illustrated embodiment, for example, branch 202 includes eight LED's 206, while branch 204 includes four LED's 210.

It should be noted that, with the LED's 206, 210 disposed in a series arrangement, the circuit 200 is protected from short circuits resulting from the failure of any LED 206, 210, as power supply 20 is a constant current power supply. In addition, the parallel zener diodes 208, 212 also protect circuit 200 against open circuits resulting from the failure of any LED 206, 210, and as a result, circuit 200 will continue to operate regardless of any open or short circuit resulting from the failure of any LED 206, 210.

Figure 14A:
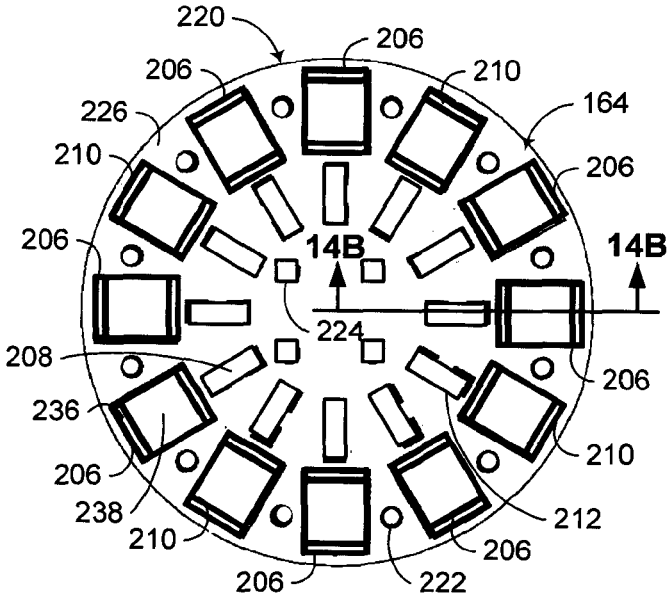
FIG. 14A is a top plan view of the fixture circuit assembly of FIG. 11.

FIG. 14 next illustrates a top plan view of fixture circuit assembly 164, which includes a printed circuit board 220 having a plurality of mounting apertures 222 and four solder points 224 to which the V+, WHITE EN, BLACK EN and CHASSIS G wires from cord 32 are soldered or otherwise electrically coupled thereto (e.g., via electrical connectors). LED's 206, 210 are mounted in an annular configuration about the periphery of printed circuit board 220, with the cooperating zener diodes 208, 212 disposed in an annular configuration radially inward from their respective LED's 206, 210. It will be appreciated that the layout of components, and the routing of conductive wires therebetween, on printed circuit board 220 will vary in different embodiments.

LED's 206, 210, as well as zener diodes 208, 210, are desirably surface mounted on printed circuit board 220. However, as shown in FIG. 14B, which is a cross-section taken through lines 14B-14B of FIG. 14A, it is desirable to mount LED's 206, 208 in an upside-down or inverted fashion relative to a top surface 226 of printed circuit board 220.

As such, printed circuit board 220 includes an annular ring of apertures 228, with each aperture 228 aligned with a respective LED 206, 210. Each LED 206, 210 includes an LED die 230 mounted on a carrier package 232, with a lens 234 secured thereto on an illuminating surface of the LED die 230. Package 232, in the illustrated embodiment, includes contact pads 236 for the anode and cathode on opposing surfaces of package 232, along with a heat pad 238 disposed opposite LED die 230. LED's 206, 210 are electrically and mechanically mounted to conductive pads 240 on printed circuit board 220 using solder 242, with lens 234 projecting into (and in some applications, completely through) aperture 228, such that LED die 230 illuminates through the opposite surface of printed circuit board 220. Concurrent with mounting LED's 206, 210 to contact pads 236, zener diodes 208, 212 may also be mounted to the printed circuit board, e.g., by soldering contact pads 244 on each zener diode 208, 212 to cooperative contact pads 246 on printed circuit board 220 using solder 248.

Figure 14B:
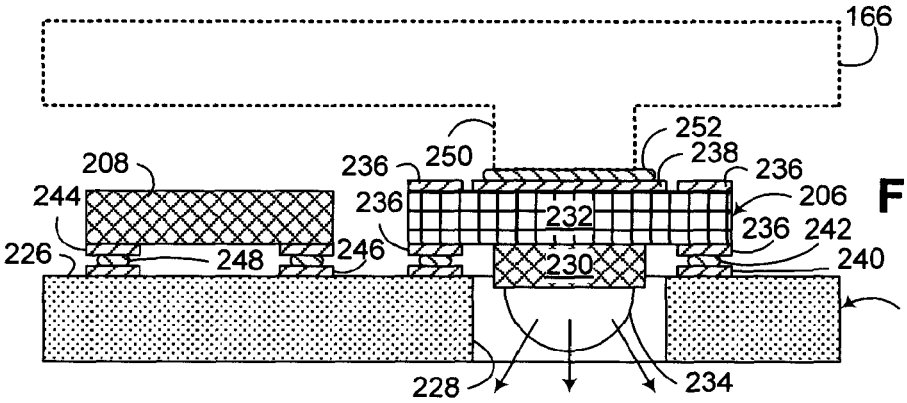
FIG. 14B is a cross-sectional view of the fixture circuit assembly of FIG. 11, taken along lines 14B-14B of FIG. 14A, shown adjoining a heat sink projection.

In contrast with conventional LED mounting techniques, where a packaged LED such as that illustrated in FIG. 14B is typically mounted with the heat pad 238 and the contact pads 236 on the same surface of package 232 facing the printed circuit board (such that the LED die faces away from the printed circuit board), the design utilized in the illustrated embodiment inverts the orientation of the LED's to expose the heat pad 238. By doing so, the head pads 238 of the LED's may be directly mounted to thermal pad 166 (FIG. 11), or in some instances directly to mounting surface 194 of housing 160 (FIGS. 12A-12F). In one embodiment, for example, thermal pad 166 may be provided with an annular array of projections 250, or alternatively, a single projection configured as an annular ring, which may directly contact the heat pad 238 of each LED 206, 210, or as shown in FIG. 14B, which may contact the heat pad through a layer of thermally conductive adhesive or paste 252. Projections may also be formed on mounting surface 194 in other embodiments, and other manners of coupling heat pads 238 to housing 160 through thermally conductive materials will be apparent to one of ordinary skill in the art having the benefit of the instant disclosure. Thus, in contrast to conventional designs where heat is often required to be conducted through a printed circuit board, embodiments of the invention enable heat to be dissipated without conducting the heat through the circuit board, and often reducing the junction temperatures at each LED.

Figure 15A:
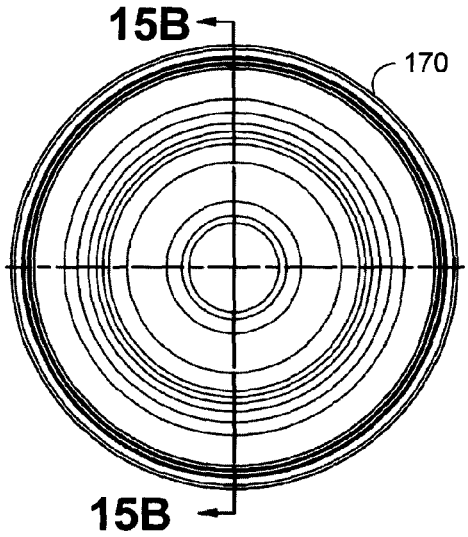
FIG. 15A is a top plan view of the lens of FIG. 11.
Figure 15B:
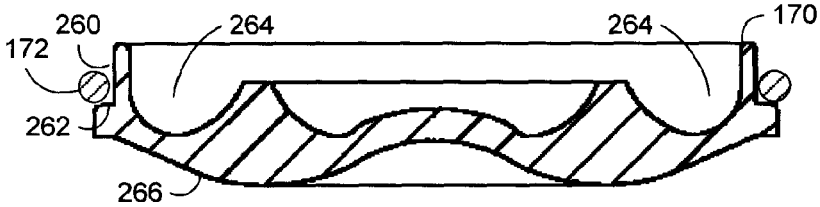
FIG. 15B is a cross-sectional view of the lens of FIG. 11, taken along lines 15B-15B of FIG. 15A.

FIGS. 15A-15B illustrate one suitable design for lens 170. Lens 170 is typically made of impact resistant clear plastic, although other materials, as well as other colors, may also be used. As best shown in FIG. 15B, lens 170 includes an outer vertically-oriented mounting surface 260 and adjoining annular shoulder 262. O-ring 172 is seated against mounting surface 260 and shoulder 262 when installed within cavity 174 of housing 160 (FIG. 11). It may be desirable to configure lens 170 such that a suction cup may be used to remove the lens from housing 160, e.g., to replace or upgrade the printed circuit board, or to install another lens having a different color or illumination pattern.

Figure 16:
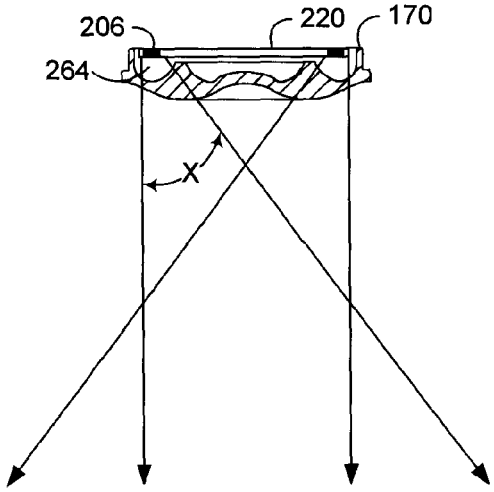
FIG. 16 is a cross-sectional view of the lens of FIG. 11, showing an exemplary light dispersion pattern generated by the lens.

As shown in FIG. 16, as well as FIG. 15B, lens 170 includes an annular cavity 264 within which printed circuit board 220, and in particular, LED's 206 are received. The profile of cavity 264, and of the outer surface 266 of lens 170 are desirably configured to generate an illumination pattern that directs the light of each LED inwardly, and toward the center axis of housing 160, e.g., at an angle of about 30 degrees. By doing so, the illumination pattern of the LED fixture 22 may be relatively consistent, with minimal hot or dark spots. In the illustrated embodiment, for example, a relatively consistent 430 lumens of light may be projected onto a work surface located about 60 inches below an LED strand 12 consistent with the invention, when operating in the primary (white) lighting mode.

Other lens designs may be utilized in other embodiments to alter the distribution profile of light based on needs. As an example, a lens profile that provides for more concentrated lighting may be desirable for surgery or fine detail work areas, or for higher ceiling mounting locations (such as high bays) that need light directed down to a work surface. Lenses may also include various lens finishes, such as frosting, to improve light output quality. It may also be desirable in some implementations to enable a lens to be removable, with or without the use of a specialized tool, to enable changes and/or retrofits in the field.

Figure 17:
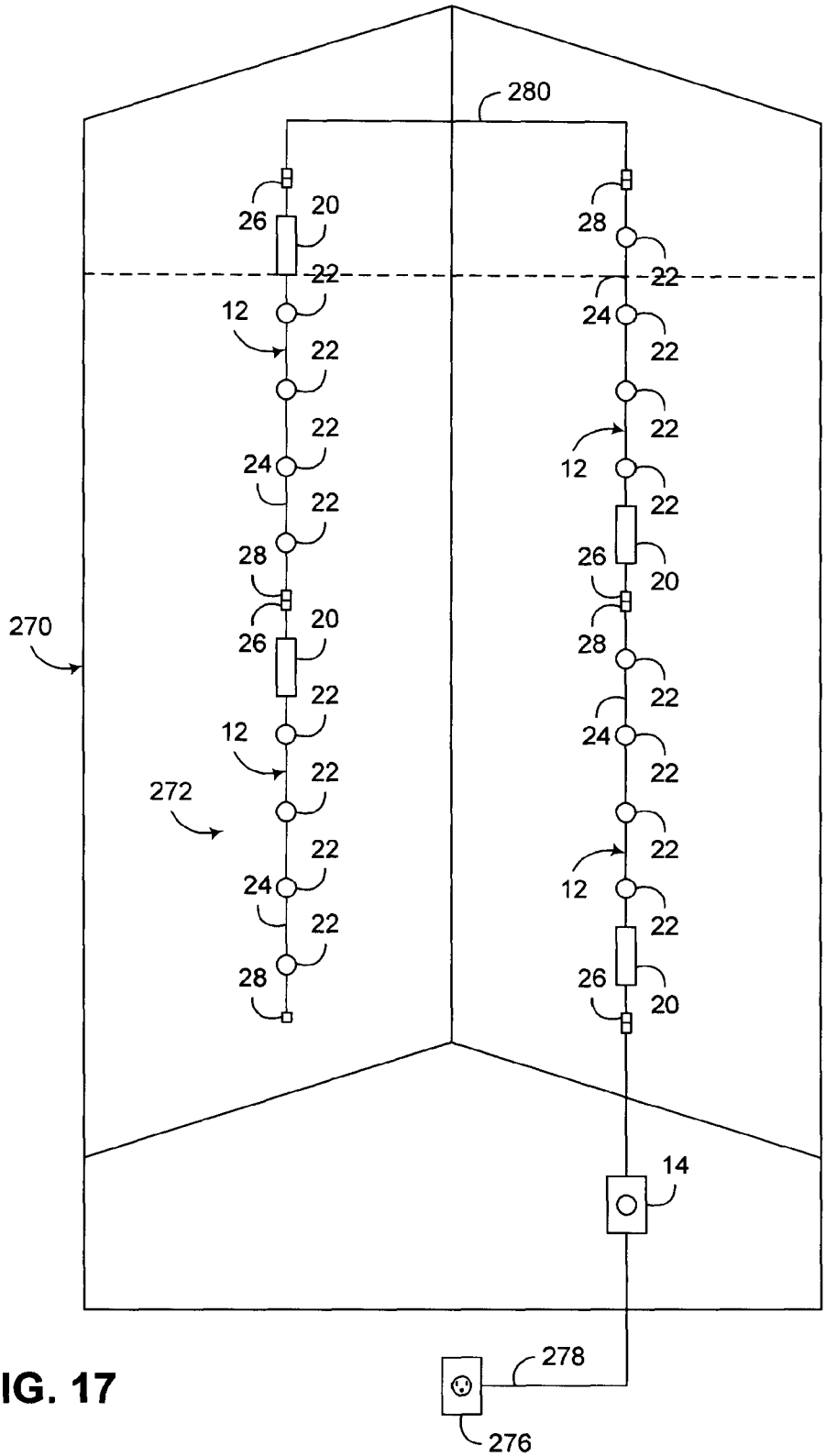
FIG. 17 is a functional block diagram of an exemplary shelter, illustrating the installation of the lighting system of FIG. 1 therein.

While the herein-described lighting system may be used in practically any lighting application, one particular application for which the lighting system is well suited is in lighting temporary shelters such as tents or rapidly deployable shelters used in the military or in disaster relief applications. FIG. 17, for example, illustrates an exemplary shelter 270, e.g., a rapidly deployable military shelter, with a first lighting arrangement 272 installed therein. Arrangement 272 includes a plurality of strands 12 configured in the manner described above, each with an inline power supply 20, four fixtures 22, an AC/DC multi-wire cord 24 and male and female NEMA connectors 26, 28. A single controller 14 couples strands 12 in arrangement 272 to an AC power source 276, and as a result, controller 14 may be used to turn strands 12 on and off, as well as select between different lighting modes. As is also illustrated in FIG. 17, controller 14 may be coupled to power source 276 via an optional extension cord 278, and strands 12 may optionally be coupled to one another via intermediate extension cords 280, or alternatively, may be coupled directly to one another.

Figure 18:
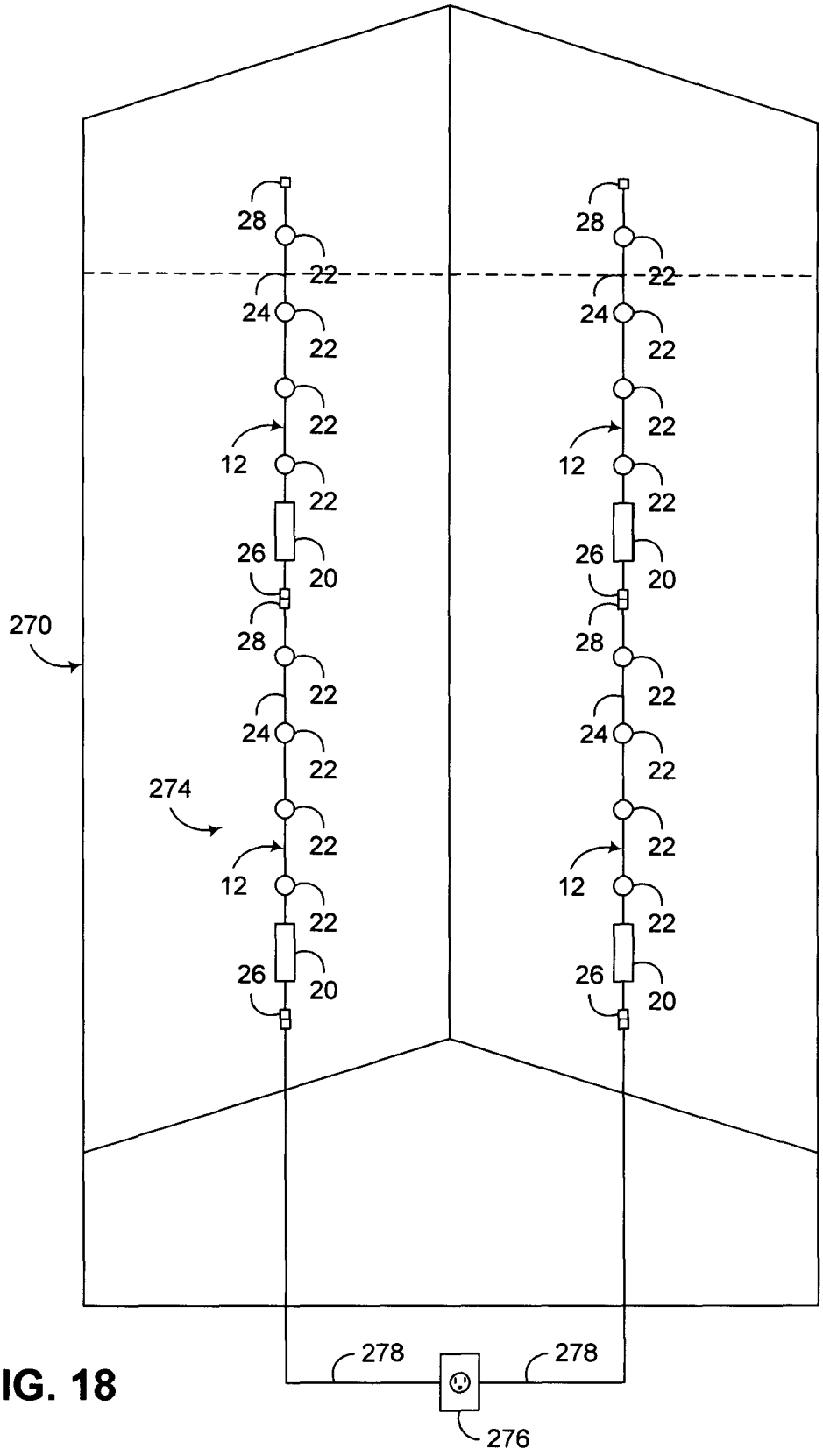
FIG. 18 is a functional block diagram of an alternate lighting arrangement for the exemplary shelter of FIG. 17.

As shown in FIG. 18, in an alternate arrangement 274, no controller is used. Instead, strands 12 connect directly to AC power source 276 in much the same manner as an extension cord (e.g., using an intermediate extension cord 278 if necessary). If each power supply 20 is provided with a user actuatable switch, then each strand 12 may be individually shut on or off, and due to the supply of regular AC power, each strand 12 will default to its primary lighting mode. In addition, if each power supply 20 is provided with a user actuatable mode switch, the primary or secondary mode may be selected individually for each strand 12. In addition, returning to FIG. 17, controller 14 may be omitted in some lighting scenarios so that multiple strands 12 may be coupled to a single outlet on AC power source 276. The number of strands that may be connected together serially in this fashion will typically be limited primarily by the current carrying capacity of the wiring.

The manner in which each strand 12 may be mounted in a shelter will vary in different embodiments. For example, hook and loop fasteners may be secured to the connectors 34 or to AC/DC multi-wire cords 24 to hang strands 12 will the fixtures 22 hanging so as to project light downwards. Other manners of mounting the strands may be used in other applications. In addition, the number and layout of strands in any given structure will typically vary depending upon the lighting requirements for that particular structure. For example, certain applications, such as medical or surgical structures, may require more lighting, and thus more strands within a given area.

Embodiments of the invention provide a number of advantages over conventional designs. For example, the herein-described fixtures utilize LED's that are mounted in an inverted fashion on the printed circuit boards, providing improved heat dissipation and cooler operation, thereby improving reliability in many applications. In addition, the circuit utilized in each fixture will continue to operate even in the event of an LED failure as a short or open circuit. Also, the power supplies utilized on each strand in the illustrated embodiment operate directly from AC power, and without the use of a transformer, resulting in light weight and efficient power supply. The power supply and LED fixtures may be sealed and have no fans, and with the exception of the NEMA connectors at the ends, the strands may be water tight and safe for short-term emersion in water, making the system suitable for indoor and outdoor use.

The illustrated embodiment also includes the capability to switch between multiple colors or lighting modes. For example, for military applications, a lighting mode may be provided for typical use and a blue lighting mode may be used for "blackout" conditions. In addition, one controller may be actuated to switch over all strands coupled to that controller, so that, for example, an entire shelter can be switched over in blackout conditions through activation of a single switch, and without requiring personnel to adjust each lighting fixture, as is required in some fluorescent-based designs.

In addition, in the illustrated embodiment, each strand of LED lights has its own power supply, and the on-board power supply may be designed to be the appropriate capacity for that strand, providing greater flexibility with respect to the number of strands that may be coupled together in a given application. The primary limitation on the number of strands that can be chained together is typically the AC current capacity of the cabling.

Various modifications may be made without departing from the spirit and scope of the invention. For example, a dimmer may be incorporated into each power supply, or into the controller, to enable the light output of individual strands and/or an entire lighting system to be controlled. In addition, due to the modularity of the fixture design, the fixture circuit assembly within each fixture is readily replaceable, either to replace a failed assembly, or to incorporate different configurations or upgrades, e.g., different numbers of lights, different colors, different illumination levels, different beam widths and orientations, etc. It may also be desirable in some embodiments to provide auxiliary DC power supply circuitry to enable auxiliary or backup power, e.g., from an automobile battery, to be used to power each strand. Such power supply circuitry may be integrated into the power supply on each strand, and accessible via a separate connector on the strand. Alternatively, each strand may be configured to pass DC power signals in addition to AC power signals to enable a single DC power supply to provide DC power to all of the strands in a system. Other modifications will be apparent to one of ordinary skill in the art. Therefore, the invention lies in the claims hereinafter appended.

What is claimed is:

1. A solid state lighting system, comprising:

a controller configured to receive an AC power signal, the controller further configured to selectively rectify the AC power signal to select a blackout lighting mode;

a plurality of solid state lighting strands coupled to the controller in a daisy-chained arrangement and configured to be mounted in a shelter, each solid state lighting strand including:

an AC/DC multi-wire cord including cooperative male and female connectors disposed at opposing ends thereof and coupled to one another by first and second AC wires and an AC ground wire extending through the AC/DC multi-wire cord;

a power supply coupled in-line with the multi-wire cord between the male and female connectors and electrically coupled to the AC wires, the power supply configured to generate a DC voltage from an AC voltage received over the AC wires, and the power supply further configured to detect rectification of the AC power signal by the controller to select the blackout lighting mode;

a plurality of solid state light fixtures coupled to the multi-wire cord and configured to hang from the multi-wire cord and project light in a downward direction when the AC/DC multi-wire cord is suspended in a generally horizontal orientation in the shelter, each solid state light fixture including a set of white Light Emitting Diodes (LED's) and a set of blue LED's disposed on a circuit board, the circuit board including first and second opposing surfaces and a plurality of apertures extending between the first and second surfaces, and wherein each of the LED's in the sets of white and blue LED's is mounted to the first surface of the circuit board and oriented in an inverted orientation to project light through a respective aperture from among the plurality of apertures in the circuit board; and a plurality of DC wires disposed within the multi-wire cord and electrically coupling the power supply to each of the solid state light fixtures to power each light fixture with the DC voltage generated by the power supply;

wherein the power supply is configured to energize the set of white LED's in each solid state light fixture when the AC power signal is not rectified by the controller, and to energize the set of blue LED's in each solid state light fixture when the AC power signal is rectified by the controller.

2. A lighting apparatus, comprising:

a circuit board including first and second opposing surfaces, the circuit board including an aperture extending between the first and second surfaces; and a solid state light mounted to the first surface of the circuit board and oriented in an inverted orientation to project light through the aperture in the circuit board.

3. The lighting apparatus of claim 2, wherein the circuit board includes first and second conductive pads disposed on the first surface thereof, wherein the solid state light includes a light emitting diode (LED) die mounted to a first surface of a carrier package, wherein the carrier packages includes first and second conductive pads disposed on the first surface thereof, and wherein the solid state light is mounted to the first surface of the circuit board with the first and second conductive pads of the carrier package respectively electrically and mechanically coupled to the first and second conductive pads of the circuit board, and with at least a portion of the LED die interposed between the carrier package and the circuit board.

4. The lighting apparatus of claim 3, wherein the solid state light further includes a lens at least partially extending through the aperture in the circuit board.

5. The lighting apparatus of claim 3, wherein the carrier package further includes a heat pad disposed on a second, opposite surface thereof, and wherein the lighting apparatus further includes a heat sink coupled to the heat pad to dissipate heat generated by the LED die in a direction away from the circuit board.

6. The lighting apparatus of claim 2, wherein the circuit board includes an annular array of apertures, and wherein the lighting apparatus further includes a plurality of solid state lights mounted to the first circuit board in an inverted orientation and respectively configured to project light through an associated aperture in the annular array of apertures.

7. The lighting apparatus of claim 3, further comprising:

a housing including a cavity configured to face in a downward direction when in use, wherein the circuit board is mounted to the housing within the cavity with the second surface of the circuit board facing in the downward direction; and a lens coupled to the housing and configured to seal the circuit board within the cavity.

8. A lighting apparatus, comprising:

an AC/DC multi-wire cord including cooperative male and female connectors disposed at opposing ends thereof and coupled to one another by first and second AC wires extending through the AC/DC multi-wire cord;

a power supply coupled to the multi-wire cord and electrically coupled to the AC wires, the power supply configured to generate a DC voltage from an AC voltage received over the AC wires;

a plurality of solid state light fixtures coupled to the multi-wire cord; and a plurality of DC wires disposed within the multi-wire cord and electrically coupling the power supply to each of the solid state light fixtures to power each light fixture with the DC voltage generated by the power supply;

wherein each light fixture is configured to operate in at least first and second lighting modes, wherein the plurality of DC wires includes at least three DC wires, a first DC wire associated with the first lighting mode and the second DC wire associated with the second lighting mode, and wherein the power supply is configured to select one of the first and second lighting modes based upon a characteristic of an AC signal received over the AC wires and selectively energize one of the first and second DC wires responsive thereto to configure each light fixture to operate in one of the first and second lighting modes.

9. The lighting apparatus of claim 8, wherein the power supply is disposed inline with the AC/DC multi-wire cord between the male and female connectors, and wherein each solid state light fixture is coupled to the AC/DC multi-wire cord by a connector and configured to hang from the connector and project light in a downward direction when the AC/DC multi-wire cord is suspended in a generally horizontal orientation.

10. The lighting apparatus of claim 9, wherein each solid state light fixture includes a housing including a downwardly facing cavity and coupled to the connector by a DC multi-wire cord, a circuit board including a plurality of light emitting diodes (LED's) disposed within the housing and a lens configured to seal the circuit board within the cavity of the housing.

11. The lighting apparatus of claim 10, wherein the circuit board is a first circuit board, wherein the lens is removable to enable the first circuit board to be replaced with a second circuit board.

12. The lighting apparatus of claim 11, wherein the first and second circuit boards differ from one another based upon at least one of number of solid state lights, illumination color, illumination level, beam width, and beam orientation.

13. The lighting apparatus of claim 8, wherein a housing for each solid state light fixture includes a plurality of vertically-oriented heat sink fins.

14. The lighting apparatus of claim 8, wherein the male and female connectors are NEMA compatible AC connectors.

15. The lighting apparatus of claim 8, wherein the power supply is configured to select the second lighting mode in response to detecting that the AC signal is a rectified signal.

16. The lighting apparatus of claim 15, wherein each light fixture includes a first set of Light Emitting Diodes (LED's) configured to be energized in the first lighting mode and a second set of LED's configured to be energized in the second lighting mode, and wherein the LED's in the first set are configured to generate a first color light, and the LED's in the second set are configured to generate a second color light.

17. The lighting apparatus of claim 16, wherein the second lighting mode is a blackout mode, wherein the LED's in the first set are configured to generate white light, and wherein the LED's in the second set are configured to generate blue light.

18. A lighting system comprising the lighting apparatus of claim 15 and a controller coupled to the lighting apparatus, the controller configured to selectively rectify the AC signal supplied to the lighting apparatus and thereby select the first or second lighting mode.

19. A lighting system comprising a plurality of the lighting apparatuses of claim 15, wherein the plurality of lighting apparatuses are coupled to one another in a daisy-chained arrangement using the respective male and female connectors thereof.

20. A lighting apparatus, comprising:

a power cord configured to receive an AC power signal;

a plurality of solid state light fixtures mechanically coupled to the power cord, each solid state light fixture configured to be driven by a DC power signal, and each solid state light fixture selectively operable in first and second lighting modes; and a power supply mechanically coupled to the power cord and electrically coupled to the plurality of solid state light fixtures, the power supply configured to generate DC power for the plurality of solid state light fixtures from the AC power signal, and the power supply further configured to selectively operate the plurality of solid state light fixtures in the first or second lighting modes based upon a characteristic of the AC signal.

21. The lighting apparatus of claim 20, wherein the power supply is configured to operate the plurality of solid state light fixtures in the second lighting mode in response to detecting that the AC signal is a rectified signal.

22. The lighting apparatus of claim 21, wherein each light fixture includes a first set of Light Emitting Diodes (LED's) configured to be energized in the first lighting mode and a second set of LED's configured to be energized in the second lighting mode, and wherein the LED's in the first set are configured to generate a first color light, and the LED's in the second set are configured to generate a second color light.

23. The lighting apparatus of claim 22, wherein the second lighting mode is a blackout mode, wherein the LED's in the first set are configured to generate white light, and wherein the LED's in the second set are configured to generate blue light.

24. The lighting apparatus of claim 22, wherein the LED's in the first set are coupled in series with one another, wherein the LED's in the second set are coupled in series with one another, and wherein each LED in the first and second sets is coupled in parallel with a respective zener diode.

25. The lighting apparatus of claim 20, wherein the power supply comprises:

an AC/DC converter circuit coupled to the AC power signal and configured to generate the DC power signal; and a mode selection circuit coupled to the AC power signal, the mode selection circuit including:

an opto-isolator configured to be energized in response to a negative voltage in the AC power signal;

a first MOSFET having a gate coupled to the opto-isolator, a source coupled to an LED return path and a drain coupled to the DC power signal and to a first enable signal associated with the first lighting mode such that the first enable signal is coupled to the LED return path when the first MOSFET is energized; and a second MOSFET having a gate coupled to the drain of the first MOSFET, a source coupled to the LED return path and a drain coupled to the DC power signal and a second enable signal associated with the second lighting mode such that the second enable signal is coupled to the LED return path when the first MOSFET is energized, whereby the first MOSFET is energized and the second MOSFET is not energized in response to an unrectified AC power signal, and the first MOSFET is not energized and the second MOSFET is energized in response to a rectified AC power signal.

26. A solid state lighting system, comprising:

a controller configured to receive an AC power signal, the controller further configured to selectively rectify the AC power signal to select a blackout lighting mode;

a plurality of solid state lighting strands coupled to the controller in a daisy-chained arrangement and configured to be mounted in a shelter, each solid state lighting strand including:

an AC/DC multi-wire cord including cooperative male and female connectors disposed at opposing ends thereof and coupled to one another by first and second AC wires and an AC ground wire extending through the AC/DC multi-wire cord;

a power supply coupled in-line with the multi-wire cord between the male and female connectors and electrically coupled to the AC wires, the power supply configured to generate a DC voltage from an AC voltage received over the AC wires, and the power supply further configured to detect rectification of the AC power signal by the controller to select the blackout lighting mode;

a plurality of solid state light fixtures coupled to the multi-wire cord and configured to hang from the multi-wire cord and project light in a downward direction when the AC/DC multi-wire cord is suspended in a generally horizontal orientation in the shelter, each solid state light fixture including a set of white Light Emitting Diodes (LED's) and a set of blue LED's; and a plurality of DC wires disposed within the multi-wire cord and electrically coupling the power supply to each of the solid state light fixtures to power each light fixture with the DC voltage generated by the power supply;

wherein the power supply is configured to energize the set of white LED's in each solid state light fixture when the AC power signal is not rectified by the controller, and to energize the set of blue LED's in each solid state light fixture when the AC power signal is rectified by the controller.

* * * * *